United States Patent [19]

Young

[11] Patent Number: 5,007,559

[45] Date of Patent: Apr. 16, 1991

[54] METHOD AND APPARATUS FOR DISPENSING A PARTICULATE MATERIAL

[76] Inventor: Cecil B. Young, 7411 Rhondda Dr., Lorton, Va. 22079

[21] Appl. No.: 361,692

[22] Filed: Jun. 1, 1989

Related U.S. Application Data

[63] Continuation of Ser. No. 887,593, Jul. 21, 1986, abandoned.

[51] Int. Cl.[5] ..... B67B 7/00

[52] U.S. Cl. ..... 222/1; 222/185; 222/189; 222/325; 222/545; 422/266; 422/267

[58] Field of Search ..... 422/263-264, 422/266-267; 222/64, 67, 52, 185, 189, 190, 325, 1, 545

[56] References Cited

U.S. PATENT DOCUMENTS

| | | | |
|---|---|---|---|
| 2,842,465 | 7/1958 | Harrison | 134/7 |
| 3,595,438 | 7/1971 | Daley | 222/67 |
| 3,850,344 | 11/1974 | Burge et al. | 222/67 |
| 4,333,493 | 6/1982 | Beiswenger et al. | 137/268 |
| 4,437,593 | 3/1984 | Bullock, III | 222/241 |
| 4,462,511 | 7/1984 | Fulmer et al. | 222/52 |
| 4,687,121 | 8/1987 | Copeland | 222/64 |
| 4,883,203 | 11/1989 | Kittscher | 222/196 X |

*Primary Examiner*—Michael S. Huppert
*Assistant Examiner*—Gregory L. Huson
*Attorney, Agent, or Firm*—Kenyon & Kenyon

[57] ABSTRACT

The disclosure relates to a method and apparatus for dispensing detergent into a washing machine. A container of particulate detergent includes a multilayer cover over the container mouth, the outer layer of which is removable to expose an inner layer of wire mesh. The relationship of the mesh size to the particulate detergent as one which prohibits passage of the detergent until dissolved at least partially by water. The receptacle is configured to receive and support the container above the inlet to the washing machine. The water sources provided within the receptacle to spray water and control the amounts through the wire mesh to dissolve the detergent. Once dissolved, the detergent can flow through the mesh and to the inlet of the washing machine.

20 Claims, 2 Drawing Sheets

METHOD AND APPARATUS FOR DISPENSING A PARTICULATE MATERIAL

This application is a continuation of application Ser. No. 887,593, filed July 21, 1986, now abandoned.

BACKGROUND AND DISCUSSION OF THE INVENTION

In an industrial washing environment, such as a hospital, hotel, or large restaurant, there is a need to wash a large number of dishes and related material at various times during the day. For this purpose there have been developed industrial washing machines which operate at relatively high temperatures and utilize automatic systems for controlling and dispensing the water, detergent, and other materials to the interior portion, or washing volume of the machine. One element of these automatic systems is a dispensing apparatus for dispensing detergent into the washing machine in controlled amounts. These detergent dispensing apparatus have suffered from some deficiencies in operation and longevity, among others.

An example of such an apparatus includes a reservoir pivotable secured to a side wall of the washing machine. This system requires moving parts to permit rotation of the reservoir. The reservoir is configured to receive a batch of detergent for dispensing purposes. The detergent may be in a container having external threaded portions which will interact with the threaded bore in the reservoir. A screen fixed to the reservoir separates the detergent from the reservoir outlet. A water delivery system sprays water onto the detergent to dissolve the detergent sufficiently to pass through the screen and be dispensed into the washing machine.

A problem with this system is the number of operating parts that are involved. The rotating apparatus will eventually either leak or break. As a result, the rather caustic soap material can be spilled onto the floor, as well as over other operating elements of the washing machine. Hot water ca be sprayed inadvertently beyond the reservoir causing damage to the operators and others in the vicinity of the washing machine. Even with a screw on container, it is rather awkward to fix a large container into the receptacle without spillage or other misfunction.

Another apparatus employs an open reservoir into which the detergent is simply poured from a soft bag into a conical screen. This system suffers from a number of deficiencies relating to spillage and damage to the machine and injury to the operator. Spillage occur in attempting to deliver the detergent from the soft bag to the reservoir. The detergent once wetted becomes caustic material and causes injury to the operators and also erodes portions of the machine to the extent where certain elements have to be replaced.

The invention discussed herein overcomes many of the problems discussed above by arriving at an apparatus which eliminates spillage during delivery and dispensing. The system developed for dispensing material is clean, safe and efficient, while enhancing the operation of the machine as well. The invention includes a disposable container having a screen across the mouth of the container for retaining the detergent therein until used. In the preferred embodiment, the cover for the mouth includes two layers. The first layer is the screen as described and the second is a peel away solid covering to seal the contents from moisture. The reservoir, on the other hand, is a fixed secured to the wall of the washing machine. The internal portions of the reservoir are configured to complement the external configuration of the container to insure a snug fit. An outlet in the reservoir is connected to the inlet for the washing machine such that all of the detergent dispensed from the container will flow through the outlet to the washing machine. Once the container is placed in the reservoir, a water source is provided in conjunction with a nozzle to direct water spray toward the screen in a controlled manner for dissolving portions of the particulate material in the vicinity of the screen. A control system not shown in this preferred embodiment operates the water as a function of the requirements of the washing machine for additional soap during washing cycles.

This system is extremely efficient, easy to operate, and safe for the operator. Once the detergent is spent, the operator obtains a new container having the particulate soap material therein. The tab on the top of the container is pulled away to peel off of the solid covering thereby exposing the screen beneath. The container is then inverted and placed in the reservoir such that the screen in the mouth of the container can fit into the complementary receptacle above the water nozzle. The container is simply placed in the receptacle where there is a snug fit between the interior receptacle surfaces and the exterior surfaces of the container.

In this manner, the screen will be located directly above the water jet or nozzle exposing the particulate material to water spray emanating from the nozzle. As the control mechanism operates the water jet to spray into the container, the detergent material in the vicinity of the screen is dissolved sufficiently to pass through the screen and fall downwardly about the water jet into the outlet. Once a sufficient amount of detergent has been dispensed, the automatic control system will shut off the water jet. The interface between the container and the receptacle walls is such that little or no water or soap will be spilled from the receptacle. In this way, users avoid danger of being sprayed by hot water or caustic soap material.

The above has been a brief description of some of the advantages of the invention when compared to some deficiencies in the prior art. Other advantages will be appreciated from the detailed description of the preferred embodiment which follows.

DETAILED DESCRIPTION OF THE PREFERRED EMBODIMENT

Figure 1:
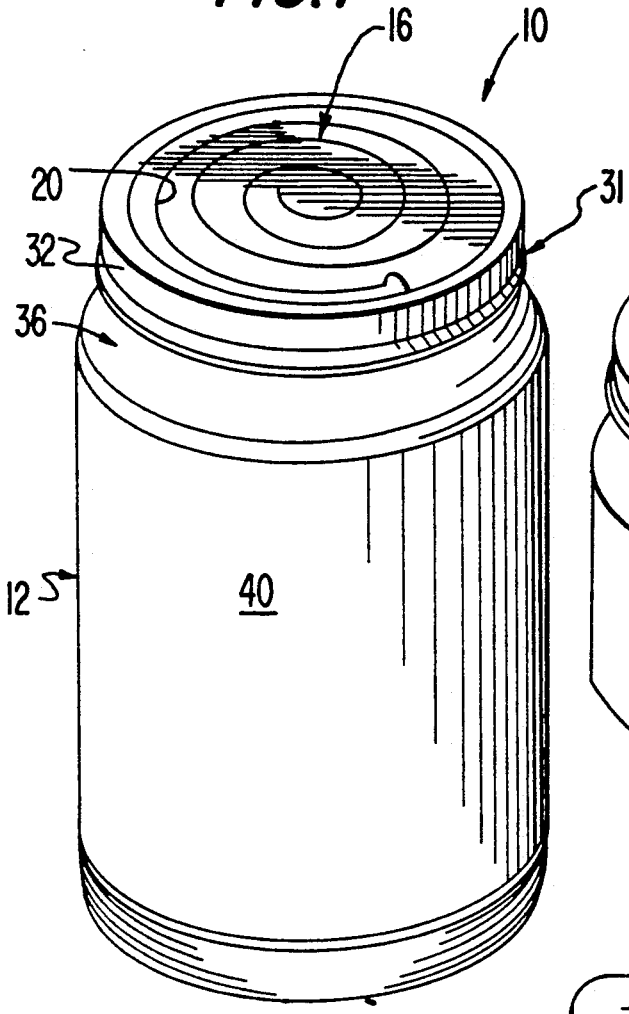
FIG. 1 is a perspective view of the container with the cover thereon.
Figure 2:
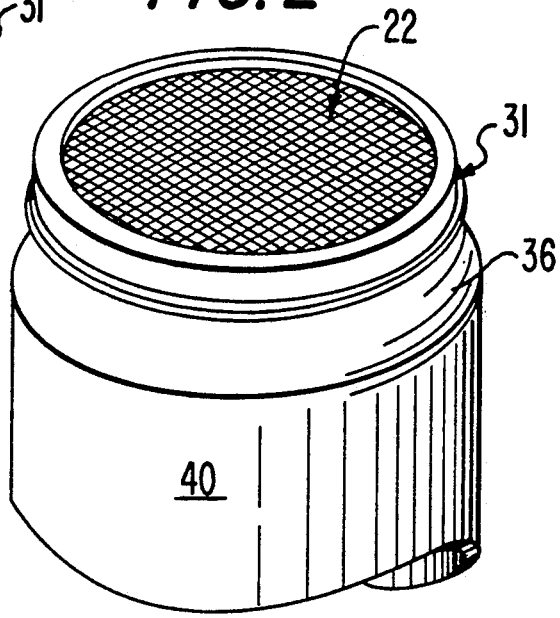
FIG. 2 is a partial view of the container of FIG. 1 with a portion of the top having been removed.

As can be seen in FIG. 1, container 10 includes a body 12 having a neck 31 defining a mouth 21 as better seen in FIG. 2 which, as shown in FIG. 1, is covered completely by a cover 14. The cover 14 is made up of a number of parts and specially configured to accomplish certain protective and retaining features of the invention. As can be seen in FIG. 1 and FIG. 2, the cover includes an inner layer screen 22 which is covered by an outer layer in the form of peel away solid impervious material 16. This outer layer 16 has a score line in the form of a spiral which extends from the exterior most portion of the cover to a position adjacent to the center as can be seen. This peel away portion includes a tab 18 which extends sufficiently from the plane of the cover for grasping by the user. To gain access to the inner layer 22, the tab 18 is grasped and simply pulled upwardly until the entire portion of the outer layer 16 is removed by peeling along the score lines 20.

The screen 22 remains fixed to the portion of the cover 32 which surrounds the neck of the container. However, in alternative embodiments, the screen can be fixed to the container in any desired manner. In preparing the container for use, the cover 14 is initially displaced from the container leaving the mouth completely open for filling by the particulate detergent. Once filled to the desired level, the cover with the inner and outer layers in fixed disposition is forced onto the mouth of the container in any desired manner. This can be a friction fit, it can be screwed on, or it can be otherwise adhered to the container. However, the seal must be sufficiently tight to prohibit the moisture from entering the container. Otherwise, if moisture or other fluid is able to find its way into the container, it may cause caking of the particulate material and adversely affect its ability to flow through the screen material.

Figure 3:
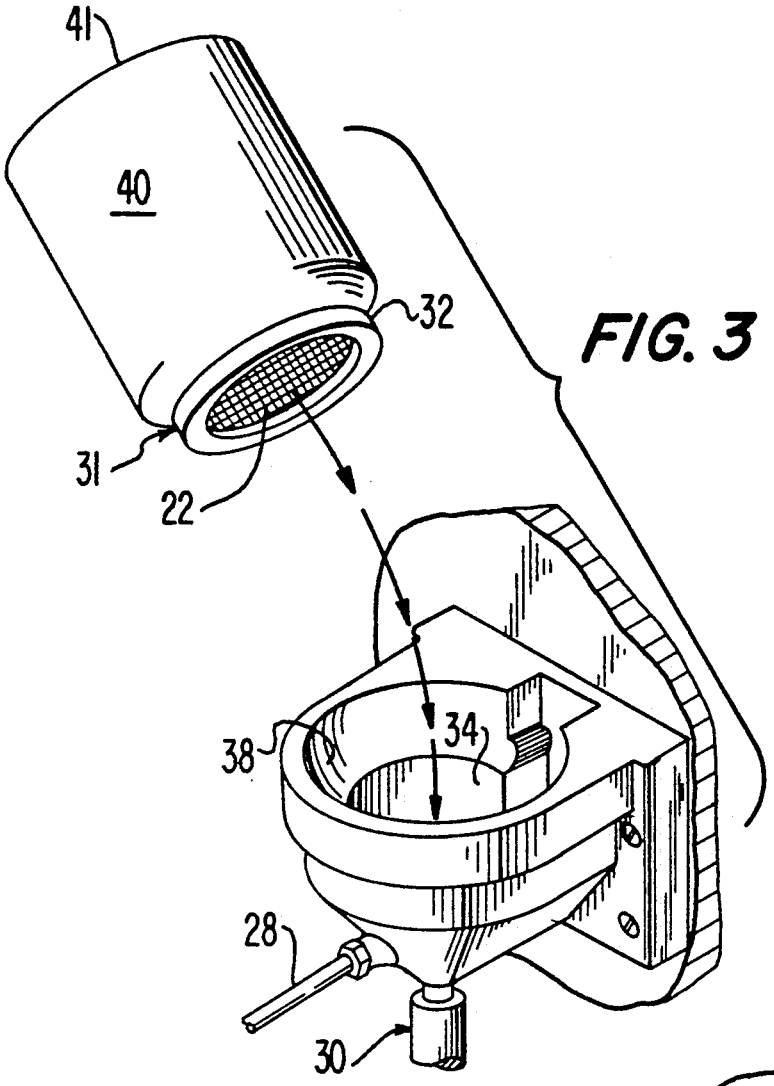
FIG. 3 shows in perspective the container and receptacle and an exploded disposition.

As can be seen in FIG. 3, a receptacle 24 for receiving the container in an upright position is shown fixed to wall 26 of an industrial washing machine. The receptacle 24 defines a number of internal surfaces generally in the form of a bowl for receiving the mouth of the container in an inverted disposition. These surfaces are specifically configured to interact with corresponding surfaces on the container to insure a snug fit between the outer walls of the container and the inner surfaces of the receptacle.

To more specifically describe the nature of the inner surfaces of the receptacle it may be helpful to first describe the configuration of the container. It should be noted that the container includes a body portion 12 which defines the largest portion of the cylinder having a circular cross section. The neck portion 31 is also cylindrical in shape but has a diameter somewhat smaller than that of the body portion 12. A shoulder 36 makes a smooth arcuate connection between the body portion 12 and the neck portion 31. Most of the neck portion 31 is covered by a skirt 32 of cover 14 as can best be seen in FIGS. 1 and 5.

This configuration provides a container which can be readily filled using a mass production process. It can be easily sealed by the two-layer cover 14 as described above and shipped to the desired location without the particulate material contained therein being adversely effected by moisture or the shipping process in general.

Figure 5:
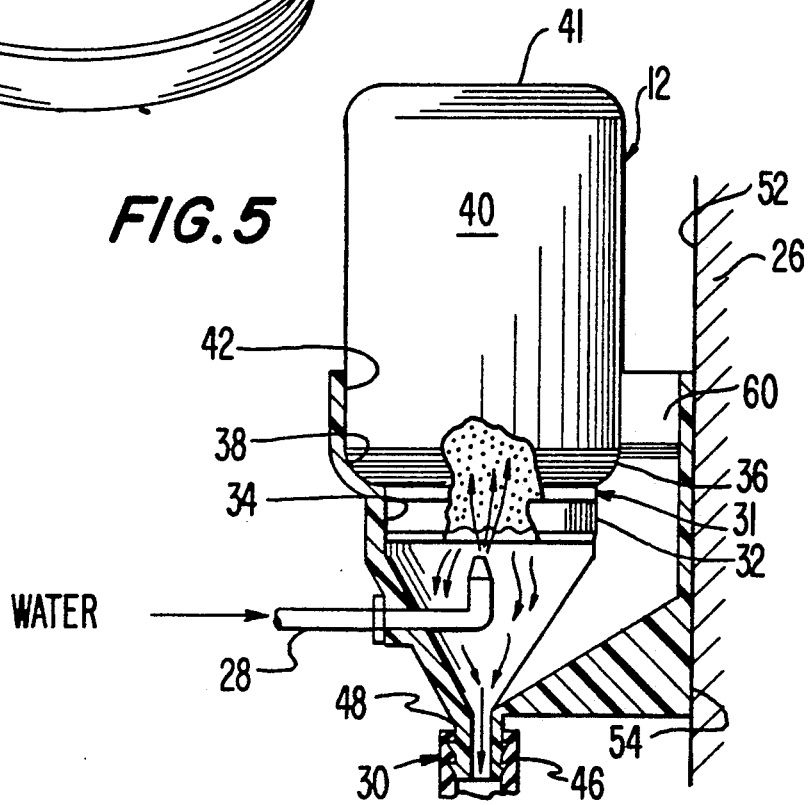
FIG. 5 is an elevation of the container and receptacle assembly as shown in FIG. 4 with a portion taken in section along lines 5–5.
Figure 4:
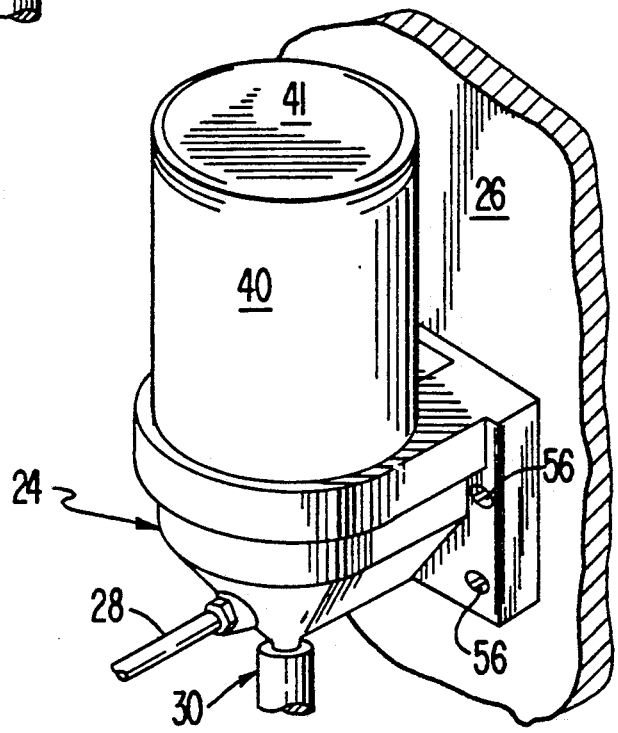
FIG. 4 is a perspective of the container and receptacle as shown in FIG. 3 with the container and operative engagement with the receptacle.

The receptacle 24 includes an outlet 48 near the bottom of the receptacle connected to an inlet 30 which eventually leads to the internal portion of the washing machine for distributing the detergent. As shown in FIG. 5 and FIG. 4, this inlet in this instance is in the form of a flexible hose 46 secured to outlet 48. The upper portion of receptacle 24 includes a first complementary neck surface 34 which is cylindrical in configuration and has a diameter only slightly larger than the outer surface of skirt 32 of cover 14 and a length slightly longer than the neck 31. With this configuration, the complementary neck surface 34 can circumscribe and snugly engage the outer surface of skirt 32 to hold the container in place. Similarly, there is defined a body engaging surface 42 and a shoulder engaging surface 38 each of which is complementary with corresponding outer surface 40 of body portion 12 and shoulder 36 of the container 10. The complementary surfaces of the receptacle 24 at every portion are only slightly larger in diameter than that of the corresponding surfaces of the container such that when the container is placed in an inverted disposition as shown in FIG. 4, surfaces 42, 38 and 34 snugly engage the corresponding surfaces 40, 36, and 32 to hold the container in place during operation.

The bottommost portion of complementary neck surface 34 is connected to a conical surface 44 which provides a closed path between the screen 22 and the outlet 48. Intermediate the screen 22 when the container is in an engaged position with the receptacle as shown, a water nozzle 50 is located intermediate screen 22 and outlet 48. This water nozzle 50 is connected to a tubing 28 which is ultimately connected to a water source and a control mechanism for dispensing water in a controlled manner and spraying the water upwardly through the screen as can be see in FIG. 5.

Receptacle 24 includes a flat bracket surface 54 for engaging a complementary surface 26 of the washing machine to which the dispensing mechanism is fixed. In this particular embodiment the receptacle 24 is fixed to wall 26 by threaded screws 56 through portions of the bracket 55. With this configuration the bracket is in a fixed disposition with respect to wall 26 of the washing machine and cannot be moved until the screws are themselves removed from the wall and the bracket 55. As can be seen in FIG. 3, the receptacle 24 defines a slot 60 which communicates with a portion of the internal complementary surfaces of the receptacle. Although in this drawing the water tubing 28 is shown extending into the receptacle from a direction opposite the slot 60, it could also extend into the receptacle through slot 60. In addition, often this equipment includes a safety switch which deactives the control machinery when the container is not in engagement with the receptacle. This control switch and also the water delivery system ca extend through the slot 60 as shown.

In this preferred embodiment, screen 22 is made of nylon and has a mesh size such that aperatures are formed which are smaller than the particulate material contained within the container. In this manner, the particulate material cannot flow through the screen. Rather, even when in an inverted position as shown in FIG. 5, the container will retain the particulate material supported on the screen until it is dissolved by the water provided by the nozzle 50. In this preferred embodiment, the edges of the screen are molded into the cover 14 itself. An alternative is that the screen can be fixed to the mouth of the container as well. Although a nylon screen is used in the preferred embodiment, other screens made of stainless steel, or other materials can be used. However, it has been found that these other types of materials typically are costly and that the nylon material can be utilized with the necessary features at a satisfactory cost to making the entire unit disposable.

Although a peel away top is shown in this embodiment, a shrink wrap, or other cover can be used to seal the screen material 22 from moisture or other exterior materials.

In operation, the container 10 is initially filled through mouth with the dry particulate material. The two-layer cover 14 is then placed over the mouth to completely seal the interior portion of the container from external fluids. The container, or containers, are then shipped to the desired location where it can be used to dispense the material as described above. Specifically, once a spent container is removed, the new container with the material therein will have the outer layer 16 peeled away by grasping tab 18 and simply pulling upward. This exposes the screen 22 as shown in FIG. 2. The container is then inverted and placed within receptacle 24 as shown in FIGS. 3 and 4. Once in place as can best be seen in FIG. 5, the container will be maintained in the proper disposition relative to water nozzle 50 and outlet of the receptacle 24 at 48. As detergent is needed, a control mechanism is operated to spray water upwardly through the screen 22 as can be seen. This dissolves the particulate material sufficiently in the vicinity of the screen to allow it to pass through the screen downwardly through the path defined by cone 44 and to outlet 48, connected to inlet 30 by hose 46 and into the washing machine. Once the desired amount of soap has been dispensed, the control system operates a valve to stop the flow of water. Once stopped, the remaining detergent material within the container will be supported above the screen ready for the subsequent operation. Once the material is completely spent, the container can simply be removed and if desired, disposed and a new container placed within the receptacle as described above.

The interaction of the container with the reservoir and the weight of the container is sufficient that soap and hot water utilized in the dispensing operation will not be spilled in the vicinity or on any users. In addition, by confining the water and the caustic soap material to the container and the receptacle, the equipment is safe from erosion over long term use. This type of soap typically draws oil and erodes metal in the vicinity of the receptacle. In addition, the chlorine which typically forms part of the detergent material also has adverse effects on the metal it engages. The materials used in the container and receptacle described above are plastic. Because the interface between the container and the receptacle are relatively snug, the water and soap will not be exposed to any metal part. Accordingly, the life of the receptacle is enhanced since there are relatively few, if any, metal parts exposed to caustic material. The increased longevity also reduces the overall cost of operating an industrial washing machine.

The above has been a discussion of the specific embodiment of applicant's invention. It should be understood that other modifications or adaptations can be employed that are different from the preferred embodiment discussed above and still come within the scope of the invention. The full scope of the invention is defined in the claims which follow. It is intended, however, that where devices, methods and apparatus which do not come within the explicit language of the claims may come within any equivalent of the preferred embodiment as measured by the contribution to the prior art.

What is claimed:

1. A method for dispensing detergent to a washing machine comprising:

(a) forming a container from plastic material with a shoulder and a neck portion integral therewith prior to insertion of detergent therein;

(b) placing the detergent in particulate form within a container, said container having a mouth for receiving the detergent;

(c) covering the container mouth with a cover material which is impermeable to particulate matter while permitting passage of water, said covering step being made prior to delivery of said container to said washing machine;

(d) said washing machine having an exterior portion and an interior portion, said washing machine having an inlet connected to said interior portion for receiving the detergent, said inlet being in communication with a fixed receptacle facing upwardly, said receptacle having a complementary portion for engaging said container mouth;

(e) delivering said container to the vicinity of said washing machine;

(f) arranging said container with respect to said receptacle to form a closed path between the container and said inlet, said particulate matter being supported above the inlet by said cover material, within the container and exposed to said inlet;

(g) subjecting said particulate material while supported within said container above said inlet to controlled amounts of fluid to dissolve particulate material in the vicinity of the container mouth sufficiently to permit passage of detergent through said cover material and to said inlet; and (h) the step of subjecting said particulate material while supported within said container above and said inlet including spraying fluid from a position exterior to said container through said cover material to said mouth of said container to dissolve material in the vicinity of the mouth in the lower portion of the container while detergent in the upper part of the container remains substantially dry.

2. The method according to claim 1 wherein said covering step includes fixing a wire mesh over the mouth of the container, said mesh having a number of apertures smaller than the particulate material within the container.

3. The method according to claim 2 wherein said covering step includes fixing a cover with a solid material impervious to fluid over said mesh, and further comprising removing said solid material prior to arrangement of the container above said inlet.

4. The method according to claim 3 wherein said solid material is a tear-away closure, and said removing step includes removing the tear-away closure while leaving the mesh fixed over the mouth of the container.

5. The method according to claim 4 wherein said container includes a neck portion circumscribing the mouth of the container, said receptacle having a complementary portion configured for substantially surrounding the neck portion and engaging said neck portion to hold the container in position with respect to said inlet, said interfacing step including placing the neck portion within the complementary neck portion of said receptacle.

6. The method according to claim 5 wherein said container further comprises a body portion in addition to said neck portion, said body portion having an effective diameter greater than that of said neck portion, and a shoulder portion connecting the body portion of the container to the neck portion, said receptacle defining a complementary shoulder portion configured for substantially surrounding the shoulder of the container, and said interfacing step including placing the container within the receptacle such that said shoulder lies within the complementary shoulder portion of the receptacle.

7. The method according to claim 6 comprising the step of subjecting said particulate material to a water source from within the receptacle for dissolving the particulate material in the vicinity of the wire mesh.

8. The method according to claim 7 wherein said water is sprayed at a temperature above about 100 degrees Farenheit.

9. A container for dispensing detergent in particulate form for use with a washing machine having a complementary receptacle comprising:

(a) a hollow body portion containing particulate detergent therein:

(b) said container having a shoulder portion and a neck portion integral therewith, said shoulder portion and said neck shaped to cooperate with said receptacle to form a substantially closed path therebetween;

(c) a mouth connected to said neck portion to permit access to the interior of the container; and (d) said mouth being covered by a cover material impervious to the particulate detergent while being pervious to a fluid sprayed through said cover from a position exterior of said container for dissolving said detergent sufficiently to pass through said cover of the wire mesh, said cover material being fixed to said container independently of said receptacle.

10. The container according to claim 9 wherein said cover includes a cover having two layers of material, an inner layer of said wire mesh and a removable outer layer to expose said inner layer of wire mesh.

11. The container according to claim 10 wherein said outer layer includes score lines to permit said outer layer to be peeled away from the remaining portion of said cover.

12. The container according to claim 11 wherein said body portion is cylindrical having a circular cross section, said mouth being defined by said neck portion and having a smaller diameter than the body portion, a shoulder connecting said body portion to said neck portion.

13. The container according to claim 12 wherein said cover is configured to fit over said mouth with a skirt circumscribing a portion of said neck portion, said outer layer having a tab extending therefrom for grasping by the user to peel away said outer layer.

14. A package for dispensing detergent in particulate form for use with a washing machine having a complementary receptacle comprising:

(a) a body portion containing particulate detergent, said body portion formed from blow molded plastic, said body portion being cylindrical in configuration with a circular cross section;

(b) a neck fixed to said body portion, said neck having a diameter less than that of said body portion;

(c) a mouth for providing access to the interior of said body portion, said mouth having a diameter less than said body portion and being formed by said neck;

(d) said neck and said body portion shaped to cooperate with said receptacle to form a substantially closed path therebetween;

(e) a cover for covering said mouth, said cover having a skirt circumscribing a portion of said neck; and (f) said cover having an inner layer and an outer layer, said inner layer comprising a wire mesh with apertures sufficiently smaller than the particulate material to prevent passage of the particulate material therethrough while permitting passage of water to dissolve said particulate detergent in the vicinity of said mesh, said outer layer comprising a solid material impervious to water and said particulate matter, said outer layer being scored to permit peeling away for exposing said inner layer, said outer layer having a tab for grasping by the user for effecting peeling away of said outer layer, said cover being fixed to said container independently of said receptacle.

15. A method for dispensing detergent in the form of particulate material to a washing machine comprising:

(a) placing the detergent into a container having a cylindrical body, a neck portion having an effective diameter less than the effective diameter of said body, and a shoulder connecting the body to the neck portion, said neck portion defining a mouth for obtaining access to the container;

(b) covering the mouth of the container with a cover having an inner mesh extending over the entire area of the mouth and an outer layer of solid impervious material scored for permitting the outer portion to be peeled away from said inner mesh, said mesh being impervious to the detergent in particulate form when placed in the container while permitting passage;

(c) the washing machine having a receptacle for receiving the neck portion and shoulder of the container, said washing machine having an inlet in communication with the amount of the receptacle, the receptacle being fixed to said machine;

(d) peeling away the solid material of said cover to expose said wire mesh;

(e) arranging the container in the receptacle with the wire mesh in a horizontal plane, facing downwardly and above said receptacle outlet, the mesh supporting the detergent above the mesh and within the container;

(f) spraying water from a position within the receptacle through the wire mesh for sufficiently dissolving the detergent in the vicinity of the wire mesh to permit passage through the mesh to the outlet; and (g) controlling the amount of water sprayed during each washing cycle to dispense the amount of detergent required.

16. An apparatus for dispensing particulate washing material into a washing machine comprising:

(a) a container for carrying said particulate washing material, said container having a shoulder portion and a neck portion;

(b) a receptacle with a complementary portion in a fixed position with respect to the washing machine for receiving the neck and shoulder portion of said container;

(c) said washing machine having an interior portion and an exterior portion with a washing machine inlet connected to said interior portion;

(d) said receptacle being connected to said inlet;

(e) said container having an opening covered with a material impervious to the particulate washing material while being pervious to water said impervious material being fixed to said container to permit insertion into said receptacle and removal therefrom without spillage of said particulate washing material;

(f) said receptacle having a means for spraying of water;

(g) said receptacle configured for cooperating with said container to support said container opening above said inlet, said means for spraying water being located to direct a water spray to said material covering and dissolve the particulate washing material sufficiently to permit passage through said impervious material.

17. The apparatus according to claim 16 wherein said covering material includes a wire mesh having aperatures sufficiently smaller than the particulate washing material to prohibit passage of the washing material therethrough.

18. The apparatus according to claim 17 wherein said washing material includes a detergent.

19. The apparatus according to claim 18 wherein said container further comprises an outer layer of material impervious to water over said wire mesh, said layer being removable to expose said wire mesh.

20. The apparatus according to claim 19 wherein said means for spraying water includes a nozzle extending upwardly from the center of said receptacle and said inlet located beneath said nozzle.

* * * * *